US012072141B2

(12) United States Patent
Yoon et al.

(10) Patent No.: US 12,072,141 B2
(45) Date of Patent: Aug. 27, 2024

(54) APPARATUS FOR PRODUCING DAIRY PRODUCTS, AND REFRIGERATOR INCLUDING SAME

(71) Applicant: SAMSUNG ELECTRONICS CO., LTD., Suwon-si (KR)

(72) Inventors: Seokjun Yoon, Suwon-si (KR); Juno Kwon, Suwon-si (KR); Sangmin Park, Suwon-si (KR); Hyekyoung An, Suwon-si (KR); Jin Jeong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 295 days.

(21) Appl. No.: 17/747,612

(22) Filed: May 18, 2022

(65) Prior Publication Data

US 2022/0275993 A1 Sep. 1, 2022

Related U.S. Application Data

(63) Continuation of application No. PCT/KR2020/018667, filed on Dec. 18, 2020.

(30) Foreign Application Priority Data

Dec. 20, 2019 (KR) ..... 10-2019-0172499
Dec. 20, 2019 (KR) ..... 10-2019-0172502
Nov. 20, 2020 (KR) ..... 10-2020-0156996

(51) Int. Cl.
*F25D 23/12* (2006.01)
*F25D 11/02* (2006.01)
(Continued)

(52) U.S. Cl.
CPC ..... *F25D 23/12* (2013.01); *F25D 11/02* (2013.01); *F25D 17/065* (2013.01); *F25D 17/08* (2013.01);
(Continued)

(58) Field of Classification Search
CPC ..... F25D 23/12; F25D 11/02; F25D 17/065; F25D 17/08; F25D 23/028; F25D 2317/0681; A01J 25/12; A01J 25/165
See application file for complete search history.

(56) References Cited

U.S. PATENT DOCUMENTS 9,648,844 B2 5/2017 Jeong et al.
2013/0056477 A1 3/2013 Go et al.
2015/0143832 A1 5/2015 Jeong et al.

FOREIGN PATENT DOCUMENTS

CN 103344084 A 10/2013
CN 203646426 U 6/2014
(Continued)

OTHER PUBLICATIONS

Office Action dated Jul. 28, 2023 issued in European Application No. 20 902 525.3.
(Continued)

*Primary Examiner* — Cassey D Bauer
(74) *Attorney, Agent, or Firm* — STAAS & HALSEY LLP

(57) ABSTRACT

A refrigerator includes an apparatus for producing dairy products. The refrigerator includes an outer cabinet, an inner cabinet provided inside the outer cabinet and including a refrigerator compartment to formed therein, and an dairy product maker provided inside the refrigerator compartment. The dairy product maker includes a case including a suction port and a discharge port to allow cool air to flow in and out, respectively, a container to store the produced dairy product therein, a heater to apply heat to the container to produce the dairy product in the container, ribs protruding from an inner surface of the case to form a cooling flow channel with the inner surface and provided between the suction port and the discharge port to cool the container, and a guide slit to guide
(Continued)

the produced dairy product overflowing into the cooling flow channel, to a bottom surface of the case.

20 Claims, 21 Drawing Sheets

(51) Int. Cl.
*F25D 17/06* (2006.01)
*F25D 17/08* (2006.01)
*F25D 23/02* (2006.01)

(52) U.S. Cl.
CPC .... *F25D 23/028* (2013.01); *F25D 2317/0681* (2013.01)

(56) References Cited

FOREIGN PATENT DOCUMENTS

| | | | |
|---|---|---|---|
| CN | 105076397 | A | 11/2015 |
| FR | 2 929 822 | | 10/2009 |
| FR | 2 929 823 | | 10/2009 |
| JP | 5-79368 | U | 10/1993 |
| JP | 4006958 | B2 | 11/2007 |
| KR | 10-1996-0014841 | B1 | 10/1996 |
| KR | 10-0218284 | B1 | 9/1999 |
| KR | 20-0384684 | Y1 | 5/2005 |
| KR | 10-0882478 | B1 | 2/2009 |
| KR | 10-2009-0114978 | A | 11/2009 |
| KR | 10-1336708 | B1 | 12/2013 |
| KR | 10-2015-0061672 | A | 6/2015 |
| KR | 10-2018-0080651 | A | 7/2018 |

OTHER PUBLICATIONS

Extended European Search Report dated Oct. 10, 2022 in European Patent Application No. 20902525.3 (8 pages).
Indian Office Action dated Oct. 26, 2022 in Indian Patent Application No. 202217034580 (6 pages).
Office Action dated Jan. 10, 2024 issued in India Application No. 202217034580.
International Search Report dated Mar. 15, 2021 in PCT Application No. PCT/KR2020/018667.
International Searching Authority ISA 237 dated Mar. 15, 2021.

APPARATUS FOR PRODUCING DAIRY PRODUCTS, AND REFRIGERATOR INCLUDING SAME

CROSS-REFERENCE TO RELATED APPLICATION

This application is a continuation application, filed under 35 U.S.C. § 111(a), of International Application PCT/KR2020/018667 filed Dec. 18, 2020, and is based on and claims priority under 35 U.S.C. § 119 to Korean Patent Applications No. 10-2019-0172499, filed on Dec. 20, 2019, No. 10-2019-0172502, filed on Dec. 20, 2019, and No. 10-2020-0156996, filed on Nov. 20, 2020, in the Korean Intellectual Property Office. The disclosures of International Application PCT/KR2020/018667, and Korean Patent Applications No. 10-2019-0172499, No. 10-2019-0172502, and No. 10-2020-0156996, the disclosure of which is are incorporated by reference herein in its their entireties.

BACKGROUND

1. Field

The present disclosure relates to a refrigerator including an apparatus for producing dairy products.

2. Description of the Related Art

A refrigerator, which generally includes a storage compartment and a cool air supply device to supply cool air to the storage compartment, is an apparatus used to keep food fresh.

The storage compartment is maintained within a certain temperature range required to keep food fresh.

The storage compartment of the refrigerator is provided with an open front. The open front is normally closed by a door to maintain the temperature of the storage compartment.

The storage compartment is divided into a refrigerator compartment and a freezer compartment by a partition wall, and the refrigerator compartment and the freezer compartment are open and closed by using a refrigerator compartment door and a freezer compartment door, respectively.

An apparatus for producing dairy products produces a dairy product such as curd, yogurt, and cheese by fermenting milk. By heating a container that contains milk, milk is fermented to produce a fermented dairy product.

Therefore, there is a need to install an apparatus for producing dairy products in a refrigerator compartment to produce a dairy product using the apparatus for producing dairy products and keep the produced dairy products refrigerated using cool air of the refrigerator compartment, thereby removing user's inconvenience.

Also, because milk or a dairy product stored in the container inside the apparatus for producing dairy products may overflow into an inner space of the apparatus for producing dairy products, a drain structure is required to prevent contamination of the apparatus for producing dairy products caused by the milk or the dairy product.

In addition, because the apparatus for producing dairy products is additionally installed in the refrigerator, there is a need to reduce a defective rate and manufacturing costs by simplifying and facilitating a manufacturing process.

SUMMARY

Provided is a refrigerator including an apparatus for producing dairy products directly disposed inside a refrigerator compartment, wherein a dairy product is prepared by the apparatus for producing dairy products disposed inside the refrigerator compartment and stored in a fresh state in the apparatus for producing dairy products.

Provided is a refrigerator including an apparatus for producing dairy products in which contamination of the apparatus for producing dairy products by milk or a dairy product flowing over a container may be minimized and malfunction of the apparatus for producing dairy products may be prevented.

Provided is a refrigerator having a structure capable of detecting misassembly of a blower fan during an assembling process in the manufacture of the apparatus for producing dairy products.

Provided is a refrigerator having a structure capable of simplifying and facilitating the manufacture of the apparatus for producing dairy products and installation of the apparatus for producing dairy products.

In accordance with an aspect of the present disclosure, a refrigerator includes an outer cabinet, an inner cabinet provided inside the outer cabinet and including a refrigerator compartment formed therein, and an dairy product maker provided inside the refrigerator compartment to produce a dairy product. The dairy product maker includes a case including a suction port and a discharge port to allow cool air to flow in and out, respectively, a container to store the produced dairy product therein and to be inserted into or withdrawn from the case, a heater to apply heat to the container to produce the dairy product in the container; a plurality of ribs protruding from an inner surface of the case to form a cooling flow channel with the inner surface when the container is accommodated in the case and provided between the suction port and the discharge port to cool the container, and a guide slit to guide the produced dairy product, overflowing, from the container into the cooling flow channel to a bottom surface of the case.

The dairy product maker may further include a blower fan configured to suck cool air from the refrigerator compartment into the case through the suction port.

The case may include a blower fan mount to form an inflow channel to communicate with the cooling flow channel to supply the cool air, and the blower fan may be mounted on the blower fan mount.

The blower fan mount may include a fan lower mount wall constituting the lower surface of the blower fan mount and supporting the blower fan, and a drain slit to drain the produced dairy product, overflowing to the blower fan mount from the container, through the inflow channel, and may be formed in the fan lower mount wall.

The dairy product maker may further include a bracket coupled to the rear surface of the case to couple the dairy product maker to the inner cabinet and support the blower fan.

The bracket may include a misassembly preventing protrusion coupled to the blower fan to prevent the blower fan from being misassembled to the blower fan mount by guiding the blower fan to be properly aligned and mounted to the blower fan mount.

A driving motor is configured to rotate the blower fan, a fan case to accommodate the driving motor and the fan, and a grommet provided at the fan case to support the blower fan.

The fan case may include an outer wall formed along a circumferential direction of the fan to cover the fan and a protrusion protruding from an outer surface of the outer wall to be coupled to the grommet, one side of the fan case may be provided with a blocking wall formed between the outer wall and the protrusion to prevent the misassembly preventing protrusion from being inserted and coupled to the blower fan, and an other side of the fan case may be provided with an insertion groove to which the misassembly preventing protrusion is inserted and coupled.

The suction port may be spaced apart from the bottom surface of the case, and the case may further include a leakage prevention bump formed between the suction port and the bottom surface of the case to prevent the produced dairy product from overflowing from the container to the bottom surface of the case from passing through the suction port.

The discharge port may be formed above the rear surface of the case, and the guide slit may be formed below the discharge port to prevent the produced dairy product, overflowing from the container, from passing through the discharge port.

The dairy product maker may further include a container assembly including the container, an assembly door to open or close the case, and a mounting bracket on which the container is detachably mounted.

The assembly door may include a separation-preventing protrusion protruding from an upper end of the assembly door to prevent the container from being separated from the mounting bracket, the mounting bracket may include a holder spaced apart from the separation-preventing protrusion and holding the container, and the container may be located between the separation-preventing protrusion and the holder.

The mounting bracket may include a first portion coupled to the assembly door and a second portion connected to the first portion and to allow the container to be detachably mounted thereon, and the first portion may include a protruding portion formed at an upper end of the first portion and inserted into one end of the assembly door and a coupling hook formed at a lower end of the first portion and coupled to the assembly door.

A guide protrusion may be formed at a side surface of the inner cabinet, and a guide groove to which the guide protrusion is coupled may be formed in an outer side surface of the dairy product maker.

The dairy product maker may further include a bracket including a coupling protrusion to be coupled to a coupling hole of the inner cabinet, and the guide protrusion may slide into the guide groove to be coupled thereto and the coupling protrusion may be inserted into the coupling hole by inserting the dairy product maker into the refrigerator compartment.

A refrigerator according to an embodiment of the present disclosure includes: an outer cabinet; an inner cabinet provided inside the outer cabinet to form a refrigerator compartment; and an apparatus for producing dairy products provided inside the refrigerator compartment, wherein the apparatus for producing dairy products includes a case, a container assembly to be accommodated in the case, a heater to apply heat to the container to produce the dairy product in the container; a circulation flow channel formed when the container is accommodated in the container assembly, and in which cool air cooling the container circulates, and a plurality of slits provided to prevent the produced dairy product, overflowing from the container, from remaining in the circulation flow channel.

The case may include a suction port through which cool air of the refrigerator compartment flows in and a discharge port through which cool air inside the case is discharged, and the plurality of slits may include a guide slit arrange adjacent to the discharge port to guide the produced dairy product, overflowing into the circulation flow channel from the container, to a bottom surface of the case.

The container assembly further includes an assembly door provided to open and close the case and a mounting bracket including a holder to hold the container, and the upper end of the container mounted on the holder may be supported by a separation-preventing protrusion protruding from the upper end of the assembly door.

The mounting bracket includes a first portion coupled to the assembly door and a second portion provided with the holder, the first portion may include a protruding portion formed at the upper end of the first portion and inserted into one end of the assembly door and a coupling hook formed at the lower end of the first portion and coupled to the assembly door.

The inner cabinet includes a guide protrusion protruding from one surface and a coupling hole formed in another surface, and the apparatus for producing dairy products includes a guide groove formed in a side surface and a bracket including a coupling protrusion coupled to the coupling hole. By pushing the apparatus for producing dairy products into the refrigerator compartment from the front to the rear, the guide protrusion may slide into the guide groove and coupled thereto and the coupling protrusion may be inserted into the coupling hole.

According to the present disclosure, a dairy product may be conveniently produced and kept fresh, and taste and quality of the dairy product may be improved and maintained constant by increasing heating and cooling efficiency.

According to the present disclosure, even when milk or a dairy product contained in the apparatus for producing dairy products leaks, contamination caused by the leaking milk or the dairy product may be minimized by using a drain structure provided in the apparatus for producing dairy products and malfunction of the apparatus for producing dairy products caused by the contamination may be prevented.

According to the present disclosure, the apparatus for producing dairy products may be easily manufactured by assembling a separately manufactured blower fan and a case, and a defective rate and manufacturing costs may be reduced because misassembly of the blower fan is detected by using a misassembly preventing protrusion.

According to the present disclosure, the container assembly may be manufactured by a simple process without using a separate fastening member, and thus a defective rate and manufacturing costs may be reduced.

DETAILED DESCRIPTION

Figure 1:
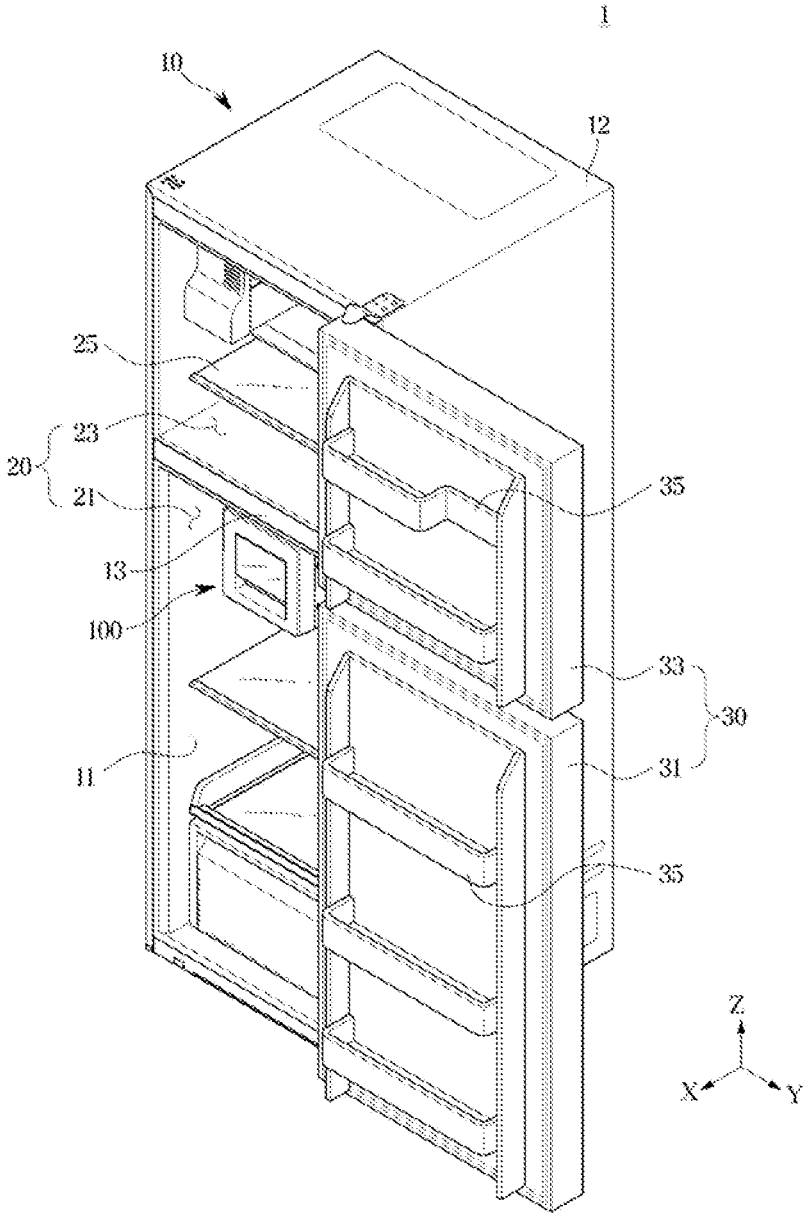
FIG. 1 is a perspective view of a refrigerator including an apparatus for producing dairy products according to an embodiment of the present disclosure.

Reference will now be made in detail to the embodiments of the present disclosure, examples of which are illustrated in the accompanying drawings. The embodiments described in the specification and shown in the drawings are only illustrative and are not intended to represent all aspects of the invention, such that various modifications may be made without departing from the spirit of the invention.

Throughout the specification, like reference numerals denote like elements or components having substantially same functions. In the drawings, shapes and sizes of elements may be exaggerated for clarity.

The terms used in the present specification are merely used to describe particular embodiments, and are not intended to limit the present disclosure. An expression used in the singular encompasses the expression of the plural, unless it has a clearly different meaning in the context. In the present specification, it is to be understood that the terms such as "including" or "having," etc., are intended to indicate the existence of the features, numbers, operations, components, parts, or combinations thereof disclosed in the specification, and are not intended to preclude the possibility that one or more other features, numbers, operations, components, parts, or combinations thereof may exist or may be added.

It will be understood that, although the terms "first", "second", etc., may be used herein to describe various elements, these elements should not be limited by these terms. The above terms are used only to distinguish one component from another. For example, a first component discussed below could be termed a second component, and similarly, the second component may be termed the first component without departing from the teachings of this disclosure. As used herein, the term "and/or" includes any and all combinations of one or more of the associated listed items.

The terms used throughout the specification "front", "rear", "upper", "lower", and the like are defined based on the drawings and the shape and position of each element are not limited by these terms. In the drawings, X-axis refers to the front-back direction, Y-axis refers to the left-right direction, and Z-axis refers to the up-down direction. Meanwhile, the directions parallel to the XY plane such as the front-back direction and the left-right direction are referred to as horizontal direction, and a direction perpendicular to the XY plane is referred to as vertical direction.

Hereinafter, embodiments of the present disclosure will be described in detail with reference to the accompanying drawings.

Figure 2:
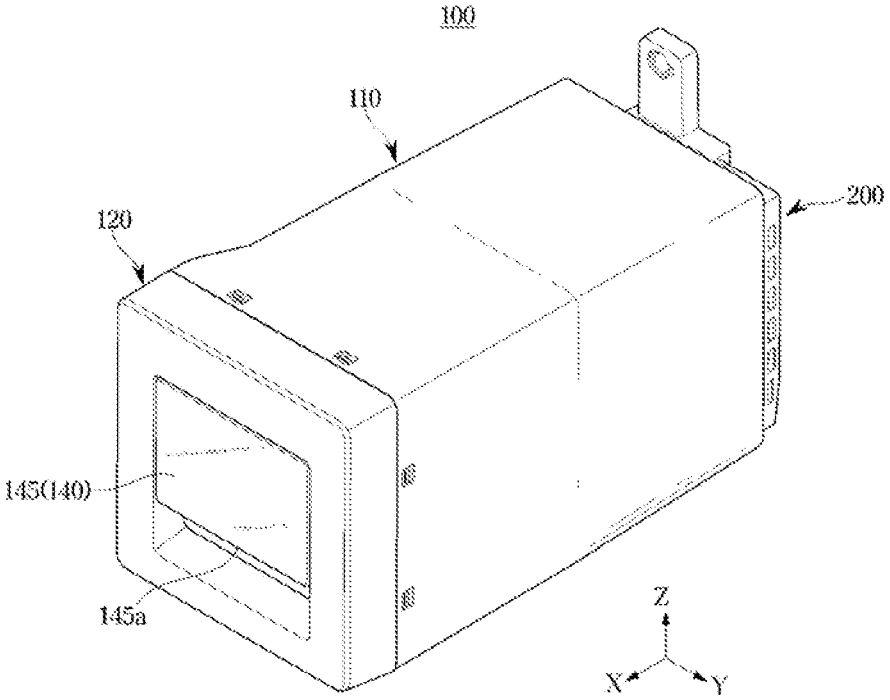
FIG. 2 is a perspective view of the apparatus for producing dairy products shown in FIG. 1.
Figure 3:
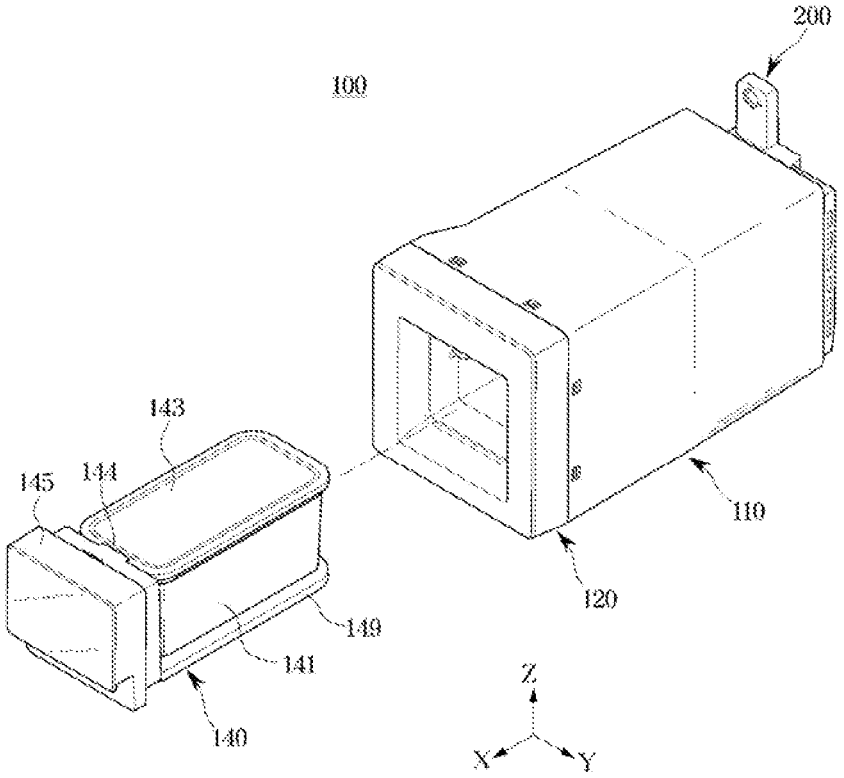
FIG. 3 is a view illustrating a container assembly of the apparatus for producing dairy products shown in FIG. 2 withdrawn from a case.
Figure 4:
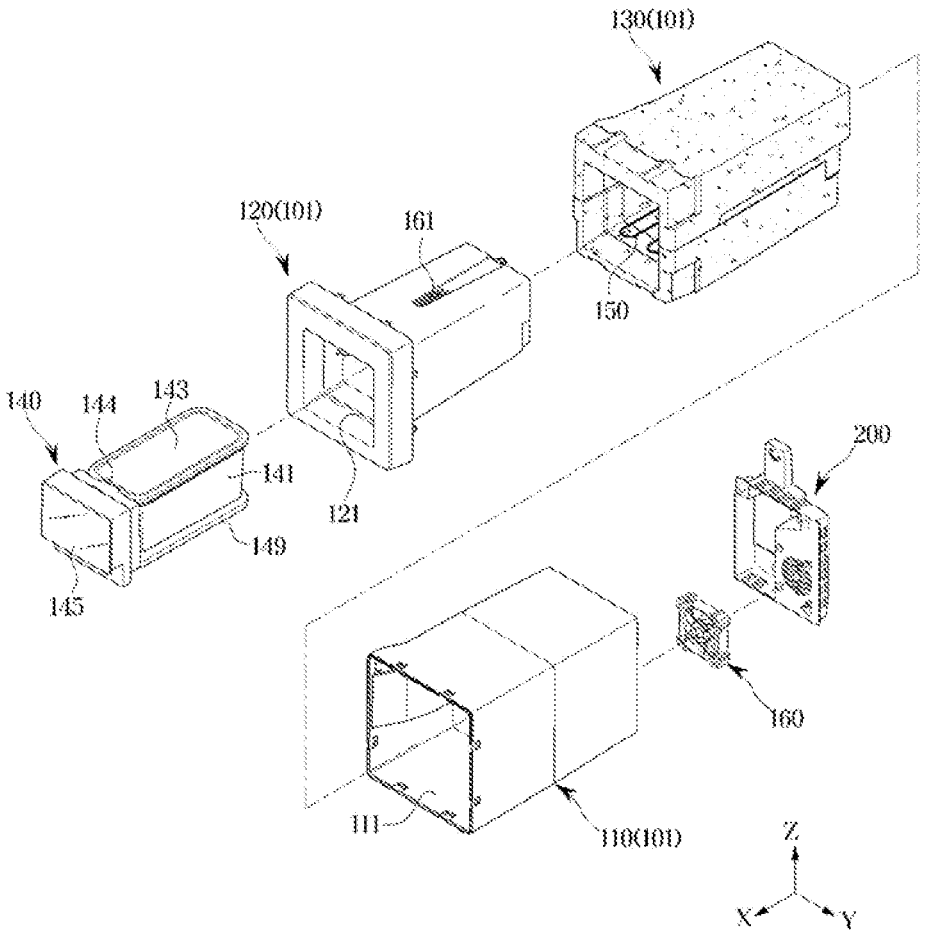
FIG. 4 is an exploded perspective view of the apparatus for producing dairy products shown in FIG. 2.

FIG. 1 is a perspective view of a refrigerator including an apparatus for producing dairy products according to an embodiment of the present disclosure. FIG. 2 is a perspective view of the apparatus for producing dairy products shown in FIG. 1. FIG. 3 is a view illustrating a container assembly of the apparatus for producing dairy products shown in FIG. 2 withdrawn from a case. FIG. 4 is an exploded perspective view of the apparatus for producing dairy products shown in FIG. 2.

Referring to FIGS. 1 to 4, a refrigerator 1 includes a main body 10, a storage compartment 20 provided inside the main body 10 and having an open front, and a door 30 pivotally coupled to the main body 10 to open and close the front of the storage compartment 20.

The main body 10 includes an inner cabinet 11 defining the storage compartment 20, an outer cabinet (not shown) defining the external appearance, and a cool air supply device (not shown) configured to supply cool air to the storage compartment 20.

The cool air supply device may include a compressor, a condenser, an expansion valve, an evaporator, a fan, and a cool air duct, and an insulator (not shown) is foamed between the inner cabinet 11 and the outer cabinet 12 of the main body 10 to prevent leakage of cool air from the storage compartment 20.

The storage compartment 20 may be partitioned into a refrigerator compartment 21 and a freezer compartment 23 by a partition wall 13, and a plurality of shelves 25 provided therein may partition the refrigerator compartment 21 and the freezer compartment 23 into a plurality of sections, respectively.

The refrigerator compartment 21 and the freezer compartment 23 may be open or closed by a refrigerator compartment door 31 and a freezer door 33 respectively pivotally coupled to the main body 10, and a plurality of door guards 35 may be mounted on the rear surface of the door 30 to accommodate foods.

An apparatus for producing dairy products 100 configured to make dairy products such as curd, yogurt, and cheese by fermenting milk may be provided inside the refrigerator compartment 21.

Although the apparatus for producing dairy products 100 is located inside the refrigerator compartment 21 in the drawings, the dairy product maker 100 may also be accommodated in a separate space independently provided in the refrigerator compartment 21.

The apparatus for producing dairy products 100 may include a case 101 including an outer case 110 defining the external appearance, an inner case 120 provided inside the outer case 110, and an insulator 130 disposed between the outer case 110 and the inner case 120.

The outer case 110 may be defined by an upper wall, a lower wall, a left wall, a right wall, and a rear wall 110*a* and the front of outer case 110 may have an opening 111 through which the insulator 130 and the inner case 120 are inserted into the outer case 110. The front of the inner case 120 may have an opening 121 through which a container 141 is inserted into or withdrawn from the inner case 120.

The inner case 120 may have an accommodation space to accommodate the container 141. The front of the accommodation space may correspond to the opening 121.

The inner case 120 may be integrally formed by injection molding. In this case, there is no gap between surfaces of the inner case 120 which may be formed when the surfaces are separately manufactured and assembled or the inner case 120 is manufactured in two pieces and assembled. Therefore, even when milk or a dairy product flowing over the container 141 into an accommodation space, filling such a gap with milk and/or the dairy product may be prevented and the overflowing milk and/or the dairy product may be easily removed.

The apparatus for producing dairy products 100 may include a container assembly 140 including a container 141 that stores milk and/or a dairy product and is accommodated in the inner case 120. The front of the container assembly 140 may be provided with a handle 145*a* held by a user.

The container assembly 140 may include the container 141 configured to store milk and/or a dairy product and inserted into an accommodation space of the inner case 120, a lid 143 to cover the top of the open container 141, an assembly door 145 to open and close the opening 121 provided at the front of the inner case 120, and a mounting bracket 149 coupled to the assembly door 145 on which the container 141 is detachably mounted.

The assembly door 145 may include the handle 145*a* formed on the front surface. The assembly door 145 may include at least one door rib 147 (See FIGS. 13 and 20) provided at the rear surface and constituting a cooling flow channel 180 (See FIG. 13).

The door rib 147 will be described below in more detail.

The apparatus for producing dairy products 100 may include a heater 150 configured to heat the container 141 to ferment milk stored in the container 141, and a blower fan 160 configured to supply cool air to the container 141 to keep the fermented milk refrigerated.

The apparatus for producing dairy products 100 may include a temperature sensor 161 configured to measure an internal temperature.

The apparatus for producing dairy products 100 may include a controller (not shown) configured to control the heater 150 and the blower fan 160 in accordance with the temperature measured by the temperature sensor 161. The controller may be provided at the front surface of the inner case 120 or a side surface of the outer case 110, or provided at the refrigerator compartment 21 outside the apparatus for producing dairy products 100. However, the embodiment is not limited thereto, and the apparatus for producing dairy products 100 may be provided at any positions of the apparatus for producing dairy products 100 or the refrigerator 1 where wired or remote control is possible.

The apparatus for producing dairy products 100 may further include a bracket 200 located behind the outer case 110 to couple the apparatus for producing dairy products 100 to the inner cabinet 11.

Figure 5:
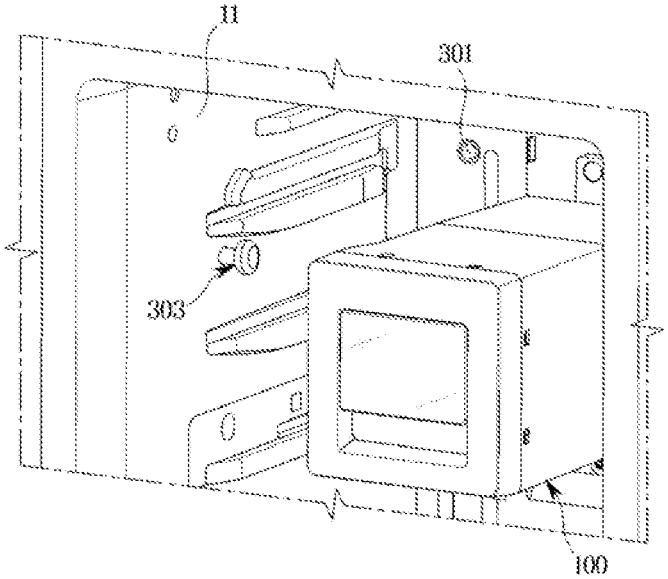
FIG. 5 is an exploded view of the apparatus for producing dairy products shown in FIG. 2 in the refrigerator compartment.
Figure 6:
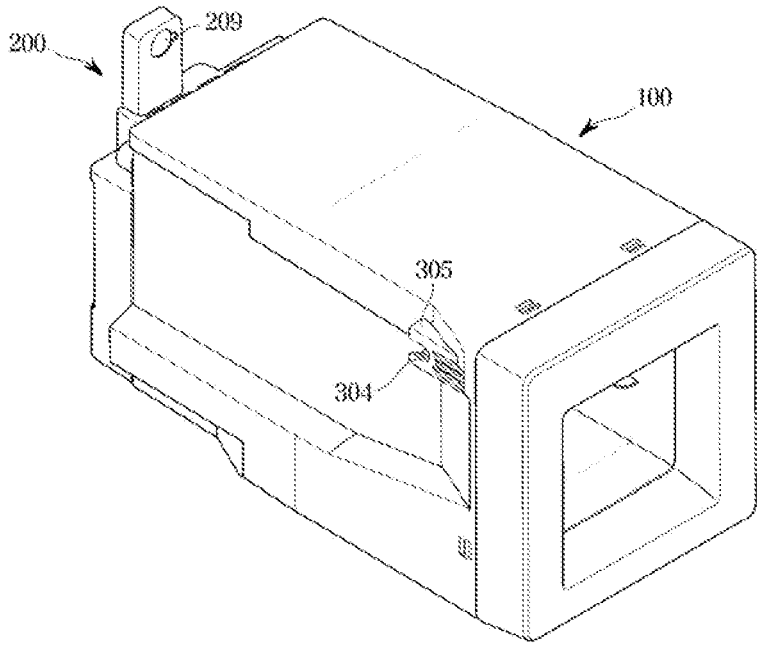
FIG. 6 is a perspective view of the apparatus for producing dairy products of FIG. 2 shown in another direction.
Figure 7:
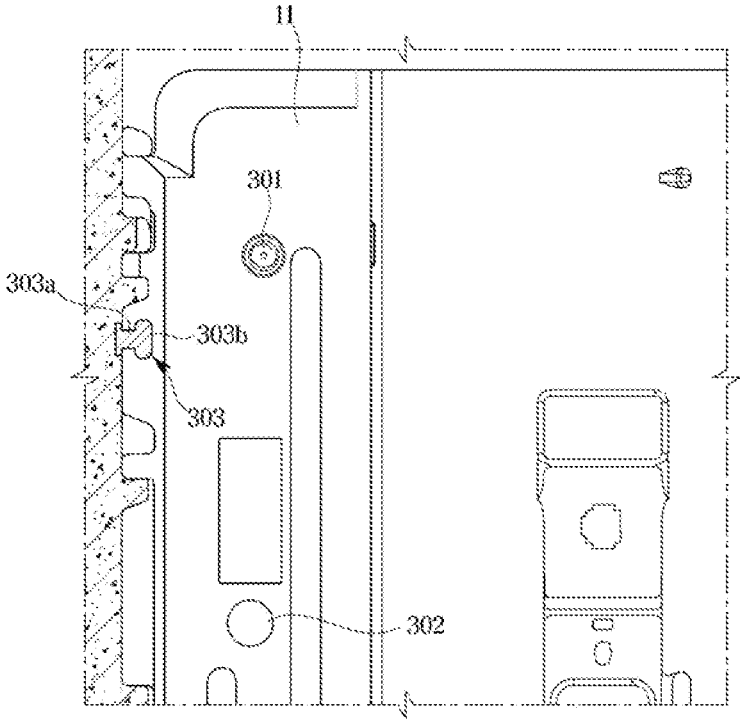
FIG. 7 is the inner cabinet of the refrigerator shown in FIG. 1 from which the apparatus for producing dairy products is omitted.
Figure 8:
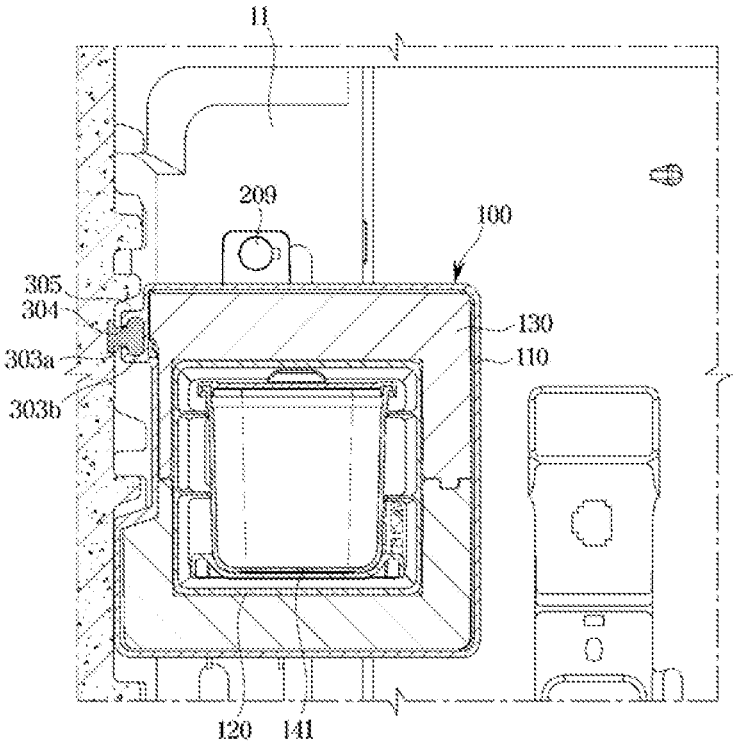
FIG. 8 is a cross-sectional view illustrating a state in which the apparatus for producing dairy products shown in FIG. 6 is fixed to the inner cabinet shown in FIG. 7.

FIG. 5 is an exploded view of the apparatus for producing dairy products shown in FIG. 2 in the refrigerator compartment. FIG. 6 is a perspective view of the apparatus for producing dairy products of FIG. 2 shown in another direction. FIG. 7 is the inner cabinet of the refrigerator shown in FIG. 1 from which the apparatus for producing dairy products is omitted. FIG. 8 is a cross-sectional view illustrating a state in which the apparatus for producing dairy products shown in FIG. 6 is fixed to the inner cabinet shown in FIG. 7.

Hereinafter, a process of fixing the apparatus for producing dairy products 100 to the refrigerator compartment 21 will be described in detail with reference to FIGS. 5 to 8.

A guide protrusion 303 may be formed on a side surface of the inner cabinet 11 constituting the refrigerator compartment 21. A guide groove 304 corresponding to the guide protrusion 303 may be formed in a side surface of the apparatus for producing dairy products 100.

The guide protrusion 303 may slide into the guide groove 304 to be coupled to the guide groove 304.

Specifically, the guide protrusion 303 may include a cylindrical extension 303*a* connected to the inner cabinet and a cylindrical head 303*b* having a greater diameter than that of the extension 303*a*. The guide groove 304 may be formed in a guide body 305 provided at an outer surface of the outer case 110, and a width of the guide groove 304 may be greater than the diameter of the extension 303*a* and smaller than the diameter of the head 303*b*.

By pushing the apparatus for producing dairy products 100 into the refrigerator compartment 21 from the front to the rear such that the extension 303*a* slides into the guide groove 304, the extension 303*a* slides into the guide groove 304 and coupled thereto, and the head 303*b* may be covered with the guide body 305. In this case, because the width of the guide groove 304 is smaller than the diameter of the head 303*b*, the guide protrusion 303 may be maintained in the coupled state without being separated from the guide groove 304 even when the apparatus for producing dairy products 100 is pulled in the left-right direction (Y) in which the guide protrusion 303 protrudes or in the up-down direction (Z) perpendicular to the direction in which the guide protrusion 303 protrudes.

The bracket 200 may include a first fastening hole 209 provided at the upper end of the bracket 200 and a coupling protrusion 210 (See FIG. 9) provided at the lower end of the bracket 200. The bracket 200 may be coupled to the rear surface of the inner cabinet 11 via the first fastening hole 209 and the coupling protrusion 210. That is, the apparatus for producing dairy products 100 may be coupled to the rear surface of the inner cabinet 11 to be located in the refrigerator compartment 21.

Specifically, the inner cabinet 11 may include a second fastening hole 301 formed at the rear surface of the inner cabinet 11 to correspond to the first fastening hole 209 of the bracket 200 and a coupling hole 302 formed on the rear surface of the inner cabinet 11 to correspond to the coupling protrusion 210 of the bracket 200.

By inserting the coupling protrusion 210 into the coupling hole 302 and coupling the first fastening hole 209 to the second fastening hole 301 using a fastening member such as a screw in a state where the first fastening hole 209 faces the second fastening hole 301, the bracket 200 may be coupled to the rear surface of the inner cabinet 11. In a state where the guide protrusion 303 is coupled to the guide groove 304, the coupling protrusion 210 of the bracket 200 is inserted into the coupling hole 302 of the inner cabinet 11 and the first fastening hole 209 of the bracket 200 may face the second fastening hole 301 of the inner cabinet 11.

As described above, because the apparatus for producing dairy products 100 is fixed to the inner cabinet 11 of the refrigerator compartment 21 by using one fastening member that joins the first fastening hole 209 and the second fastening hole 301, arrangement of the apparatus for producing dairy products 100 in the refrigerator compartment 21 and detachment thereof for repairs may be easily performed.

Figure 9:
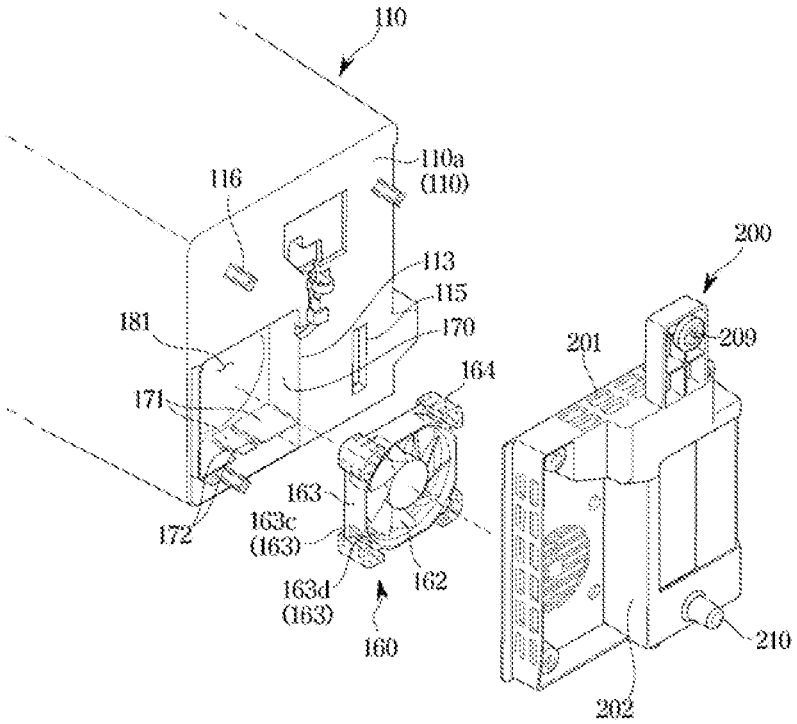
FIG. 9 is an exploded rear view of the apparatus for producing dairy products shown in FIG. 2.
Figure 10:
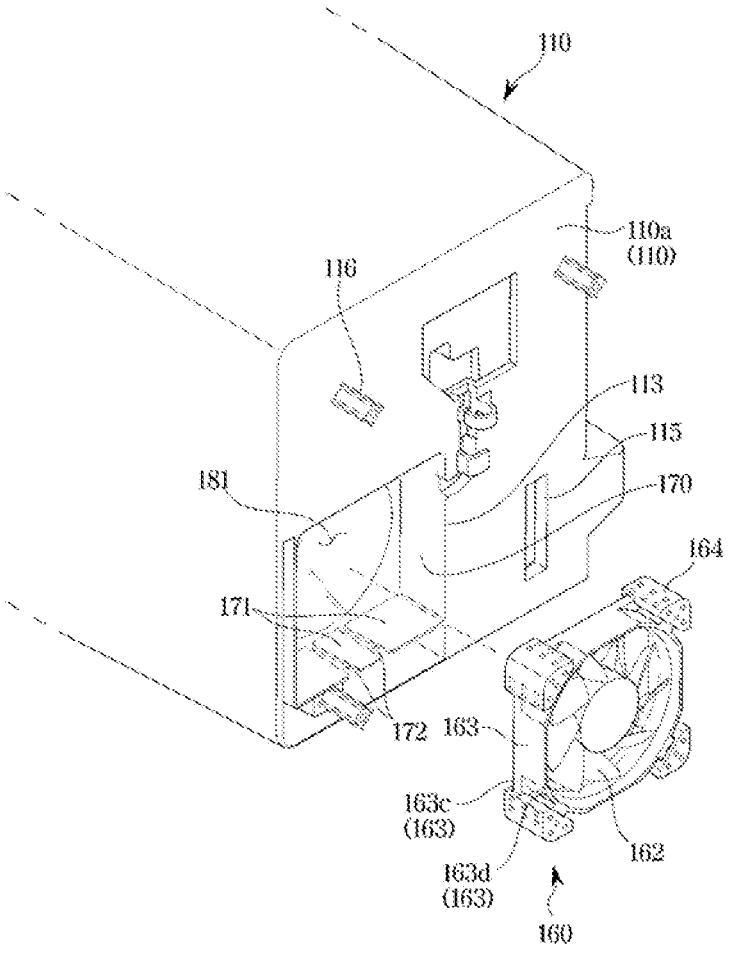
FIG. 10 is an enlarged view of the blower fan mount and the blower fan shown in FIG. 9.
Figure 11:
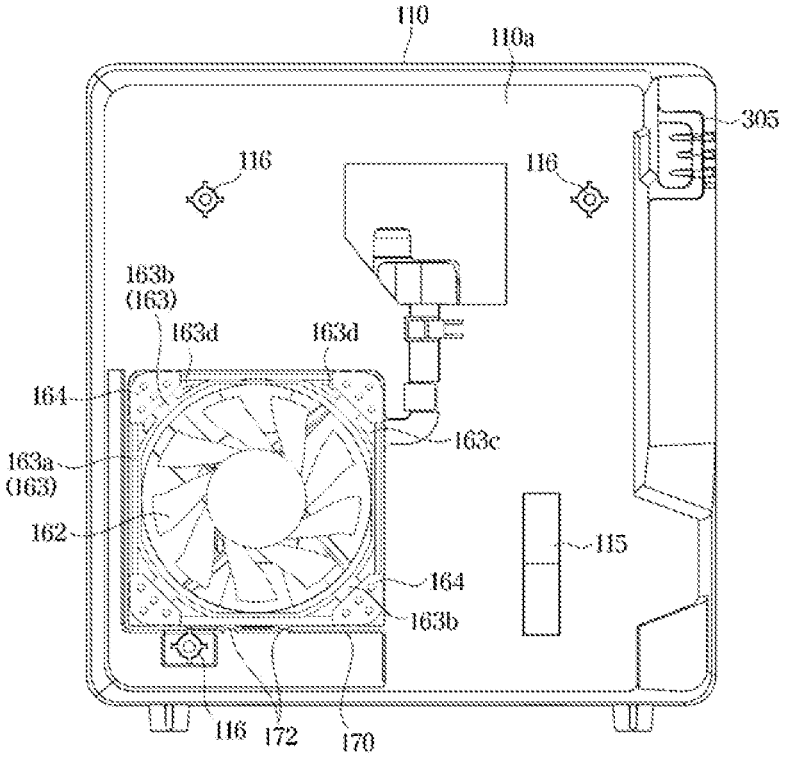
FIG. 11 is a rear view of the apparatus for producing dairy products shown in FIG. 2 from which the bracket is omitted.
Figure 12:
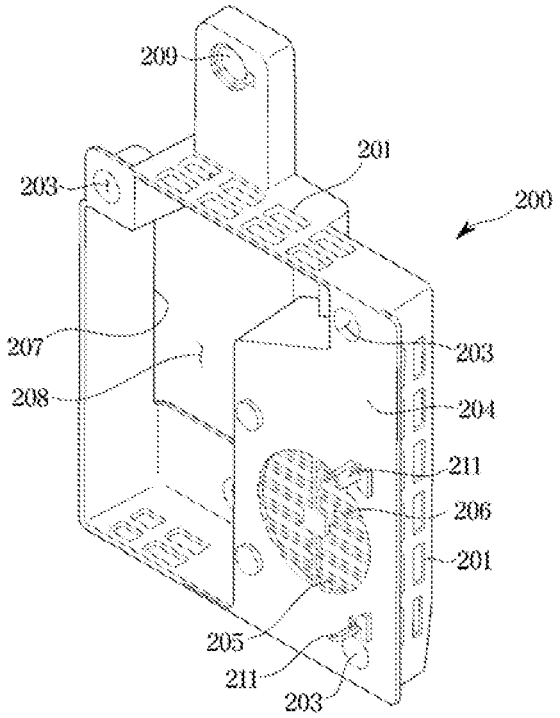
FIG. 12 is a view illustrating the bracket of the apparatus for producing dairy products shown in FIG. 2.

FIG. 9 is an exploded rear view of the apparatus for producing dairy products shown in FIG. 2. FIG. 10 is an enlarged view of the blower fan mount and the blower fan shown in FIG. 9. FIG. 11 is a rear view of the apparatus for producing dairy products shown in FIG. 2 from which the bracket is omitted. FIG. 12 is a view illustrating the bracket of the apparatus for producing dairy products shown in FIG. 2.

Referring to FIGS. 9 to 12, the blower fan 160 may be mounted on the outer rear surface of the outer case 110. The blower fan 160 may include a fan 162 including a plurality of blades, a driving motor (not shown) configured to rotate the fan 162, a fan case 163 accommodating the driving motor and covering the fan 162, and a plurality of grommets 164 coupled to edges or vertices of the fan case 163 to reduce vibration and noise caused by the fan 162.

The fan 162 and the driving motor may be accommodated in the fan case 163, and the fan 162, the driving motor, the fan case 163, and the grommets 164 may be separately manufactured as one assembly. The grommets 164 may be formed of an elastic member such as rubber or silicone.

The blower fan 160 may be provided on an outer rear surface of the outer case 110. Specifically, the blower fan 160 may be inserted into a blower fan mount 170 and mounted thereon.

The rear wall 110*a* of the outer case 110 may be provided with the blower fan mount 170 having an inflow channel 181 formed thereon to suck cool air inside the refrigerator compartment 21. The blower fan 160 may be mounted on the blower fan mount 170. The blower fan 160 may be mounted in the inflow channel 181 formed in the blower fan mount 170. A second discharge port 115 through which sucked cool air is discharged into the apparatus for producing dairy products 100 may be provided on the rear surface of the outer case 110.

A first suction port 113 may be formed at one end of the blower fan mount 170 and the blower fan 160 may be mounted on the blower fan mount 170 to communicate with the first suction port 113 through one side thereof. One end of the inflow channel 118 may communicate with the first suction port 113.

Specifically, the blower fan 160 may be inserted into the blower fan mount 170 to be mounted thereon, the blower fan mount 170 recessed as a part of the rear wall 110*a* of the outer case 110. The grommets 164 may be disposed between the fan case 163 and the blower fan mount 170 to prevent the fan case 163 from being in contact with the inner surface of the blower fan mount 170. Therefore, even when vibration is generated in the fan case 163 due to rotation of the fan 162, the grommets 164 may buffer the vibration and prevent the fan case 163 from colliding with the blower fan mount 170, thereby having effects on reducing vibration and noise.

The blower fan mount 170 may include a fan lower mount wall 171 constituting one surface of the blower fan mount 170. The fan lower mount wall 171 may protrude from the rear surface of the outer case 110 in the backward direction. Specifically, the fan lower mount wall 171 may be provided at a lower end of the outer surface of the rear wall 110*a* in the form of a plate-shaped rib extending in the horizontal direction.

One end of the fan lower mount wall 171 may correspond to a part of the first suction port 113. The fan lower mount wall 171 constituting the lower surface of the blower fan mount 170 may support the blower fan 160 under the blower fan 160.

The fan lower mount wall 171 may be provided with a drain slit 172. Specifically, the drain slit 172 in the form of a gap may penetrate the fan lower mount wall 171 that supports the blower fan 160. In other words, with respect to the fan lower mount wall 171, a space above the fan lower mount wall 171 may be connected to a space below the fan lower mount wall 171 via the drain slit 172. Therefore, milk and/or a dairy product disposed on the upper surface of the fan lower mount wall 171 may be drained into the space below the fan lower mount wall 171 through the drain slit 172.

The space below the fan lower mount wall 171 may be connected to the outside of the apparatus for producing dairy products 100. Even when milk and/or the dairy product flowing over the container 141 reach the upper surface of the blower fan mount 170 that supports the blower fan 160 through the inflow channel 181, the milk and/or the dairy product may be drained out of the apparatus for producing dairy products 100 through the drain slit 172 by gravity or fine vibration of the blower fan 160. Therefore, contamination of the blower fan 160 by the milk or the dairy product flowing over the container 141 may be prevented and malfunction of the apparatus for producing dairy products 100 caused by the contamination may be prevented.

Hereinafter, the structure of the bracket 200 and the coupling process will be described in detail.

One or plurality of first coupling pieces 116 may be provided on the outer surface of the rear wall 110*a* of the outer case 110, and one or plurality of second coupling pieces 203 may be provided on the bracket 200 at positions corresponding to the first coupling pieces 116. When the bracket 200 is mounted on the rear of the outer case 110, the first coupling piece 116 and the second coupling piece 203 may be coupled to each other as a pair, and the first coupling piece 116 and the second coupling piece 203 may be fixed using a fastening member such as a screw.

The bracket 200 may include a support wall 204 to support the blower fan 160 to prevent the blower fan 160 from being separated from the blower fan mount 170.

Specifically, the blower fan 160 may be inserted into the blower fan mount 170 and fixed thereto by friction between the grommets 164 and the blower fan mount 170. That is, a separate fastening member such as a screw may not be used. In this case, the blower fan 160 may be separated from the blower fan mount 170 by impact or vibration.

When the bracket 200 is mounted on the rear wall 110*a* of the outer case 110, the support wall 204 may prevent the blower fan 160 from moving toward the first suction port 113 to be separated from the blower fan mount 170 and the blower fan 160 may be arranged on the blower fan mount 170 not to move.

Therefore, by simply inserting the blower fan 160 into the blower fan mount 170 and coupling the bracket 200 thereto, the blower fan 160 may be mounted on the blower fan mount 170 not to be separated therefrom without conducting a separate fixing process to fix the blower fan 160 to the blower fan mount 170, and thus the apparatus for producing dairy products 100 may be easily manufactured.

A suction grille 205 may be provided in the support wall 204 of the bracket 200 at a position corresponding to the blower fan 160. The suction grille 205 may have a plurality of third suction ports 206. The third suction ports 206 may communicate with suction ports 113 and 123 formed in the case 101. The blower fan 160 may suck air from the suction grille 205.

The bracket 200 may include a third discharge port 207 where cool air discharged from the apparatus for producing dairy products 100 flows. The third discharge port 207 may be formed at a position corresponding to discharge ports 115 and 125 of the case 101.

The bracket 200 may include a heat dissipation flow channel 208 including a space between the rear surface of the outer case 110 and the rear surface of the inner cabinet 11. One end of the heat dissipation flow channel 208 may communicate with the discharge ports 115 and 125 of the case 101, and the other end may communicate with the third discharge port 207. Therefore, cool air discharged out of the case 101 from the inside of the case 101 may be discharged to the refrigerator compartment 21 through the heat dissipation flow channel 208.

Side surfaces of the bracket 200 may have a plurality of vents 201 for smooth flows of cool air.

The bracket 200 may include a partition wall 202 to prevent the cool air discharged through the discharge ports 115 and 125 from being sucked back into the suction ports 113 and 123 and recirculated.

Cool air discharged through the second discharge port 115 may be guided to the heat dissipation flow channel 208 without being mixed with cool air sucked through the first suction port 113 by the partition wall 202 provided at the heat dissipation bracket 200, and thus recirculation of cool air is prevented and cooling efficiency of the apparatus for producing dairy products 100 may be increased.

The bracket 200 may include a misassembly preventing protrusion 211 provided to correspond to the blower fan 160 and capable of identifying whether the blower fan 160 is misassembled. The misassembly preventing protrusion 211 may be formed in a form protruding from the support wall 204. The misassembly preventing protrusion 211 may be provided in plural.

The fan case 163 of the blower fan 160 may include an outer wall 163*a* formed along the circumferential direction of the fan 162 to cover the fan 162 and a plurality of protrusions 163*b* protruding from the outer surface of the outer wall 163*a* to be coupled to the grommets 164.

A blocking walls 163 may be provided on the front surface of the fan case 163 to prevent the misassembly preventing protrusion 211 from being inserted and coupled thereto. The blocking wall 163*c* may be formed between the outer wall 163*a* and the protrusion 163*b*. The blocking wall 163*c* may be formed at a position corresponding to the misassembly preventing protrusion 211 when the bracket 200 is coupled to the outer case 110.

An insertion groove 163*d* to which the misassembly preventing protrusion 211 is inserted and coupled may be formed on the rear surface of the fan case 163. The insertion groove 163*d* may be formed between the outer wall 163*a* and the protrusion 163*b*. That is, the insertion groove 163*d* may be formed on the rear surface of the blocking wall 163*c* that is formed on the front surface of the fan case 163.

Specifically, the insertion groove 163*d* may correspond to a space between the grommet 164 coupled to the protrusion 163*d* and the outer wall 163*a*. The insertion groove 163*d* may be formed at a position corresponding to the position of the misassembly preventing protrusion 211 when the bracket 200 is coupled to the outer case 110.

The blocking wall 163*c* and the insertion groove 163*d* may be provided in plural to correspond to the misassembly preventing protrusion 211.

Cool air may be discharged into the case when the blower fan 160 includes a driving motor rotating in only one direction and is mounted on the blower fan mount 170 such that the front surface of the fan case 163 faces the front of the outer case 110 and the rear surface of the fan case 163 faces the rear of the outer case 110. However, the embodiment is not limited thereto, and the driving motor may be a driving motor rotating in both directions.

The blower fan 160 may be mounted on the blower fan mount 170 such that the front surface of the fan case 163 faces the front of the outer case 110 and the rear surface of the fan case 163 faces the rear of the outer case 110. In this case, the insertion groove 163*d* is exposed to the outside of the apparatus for producing dairy products 100 and arranged to face the bracket 200. When the bracket 200 is coupled to the outer case 110, the misassembly preventing protrusion 211 corresponding to the insertion groove 163*d* may be inserted into the insertion groove 163*d*.

On the contrary, in the case where the blower fan 160 is mounted on the blower fan mount 170 such that the rear surface of the fan case 163 faces the front of the outer case 110 and the front surface of the fan case 163 faces the rear of the outer case 110, the blocking wall 163*c* is exposed to the outside of the apparatus for producing dairy products 100 and the blocking wall 163*c* prevents the misassembly preventing protrusion 211 from being coupled to the blower fan 160.

In the case where the misassembly preventing protrusion 211 is not inserted and coupled to the blower fan 160, the heat dissipation bracket 200 cannot be coupled to the outer case 110 or there may be a step difference. Therefore, it may be determined that the blower fan 160 is not normally assembled to the blower fan mount 170 in a state where the arrangement of the front and rear surfaces of the blower fan 160 is reversed with respect to the heat dissipation bracket 200.

Figure 13:
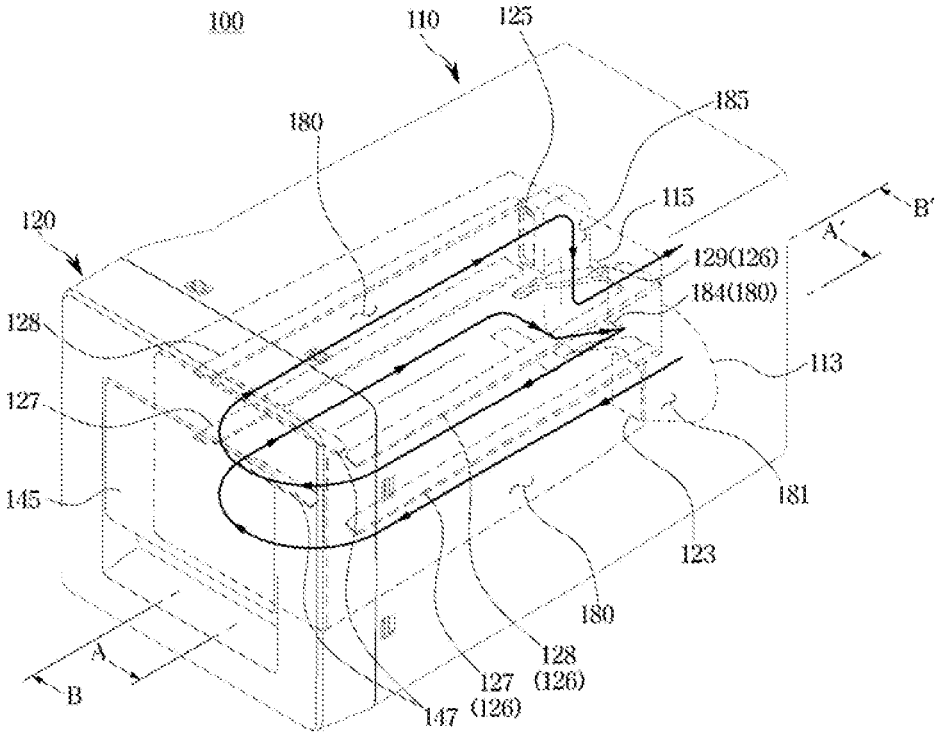
FIG. 13 is a view illustrating cool air circulating in a flow channel of the apparatus for producing dairy products shown in FIG. 2.
Figure 14:
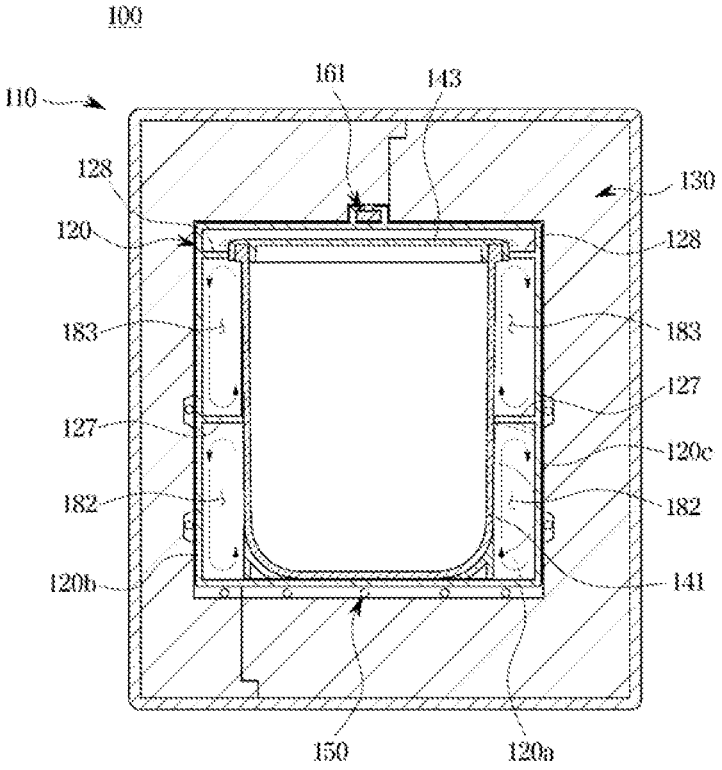
FIG. 14 is a cross-sectional view of the apparatus for producing dairy products shown in FIG. 13.
Figure 15:
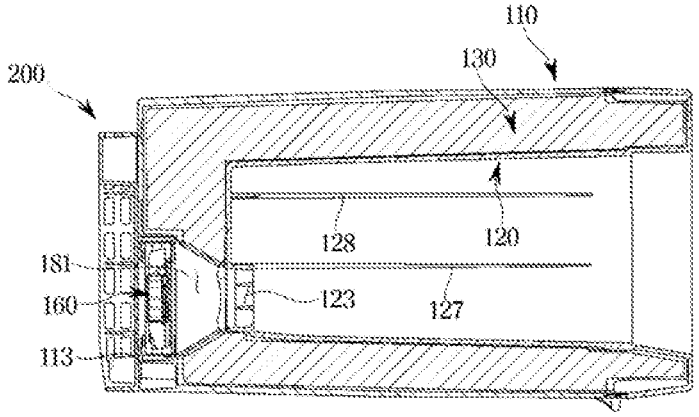
FIG. 15 is a cross-sectional view taken along line A-A' of FIG. 13 in a state where the container assembly is omitted.
Figure 16:
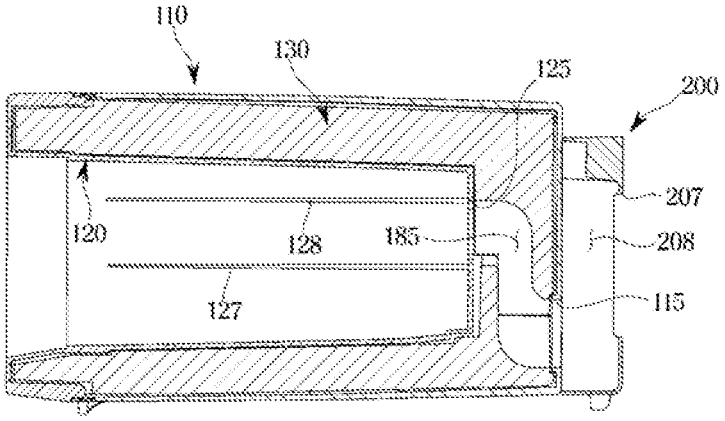
FIG. 16 is a cross-sectional view taken along line B-B' of FIG. 13 in a state where the container assembly is omitted.
Figure 17:
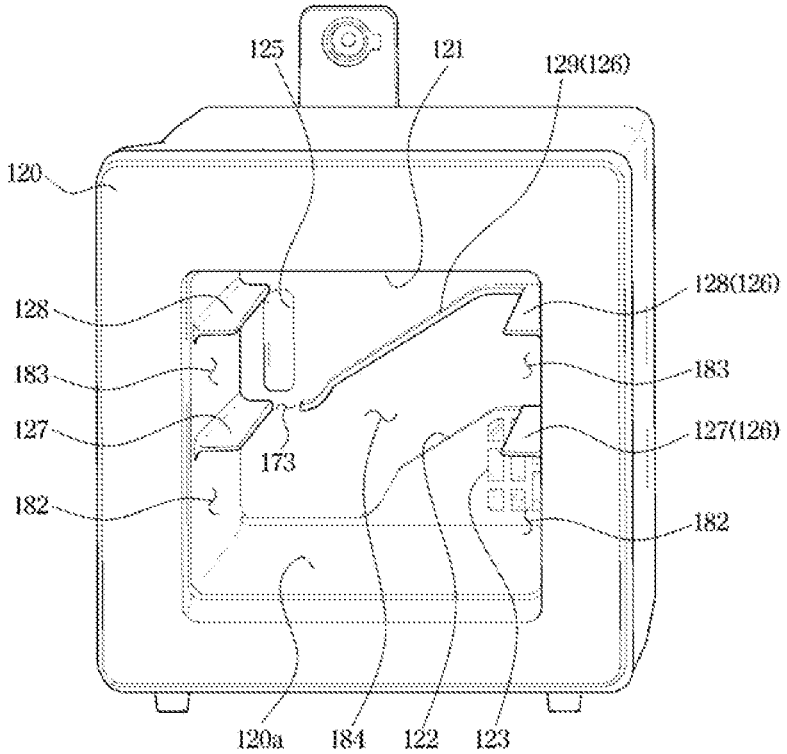
FIGS. 17, 18, and 19 are cross-sectional views of a flow channel formed in the inner case of the apparatus for producing dairy products shown in FIG. 2 in various angles.
Figure 18:
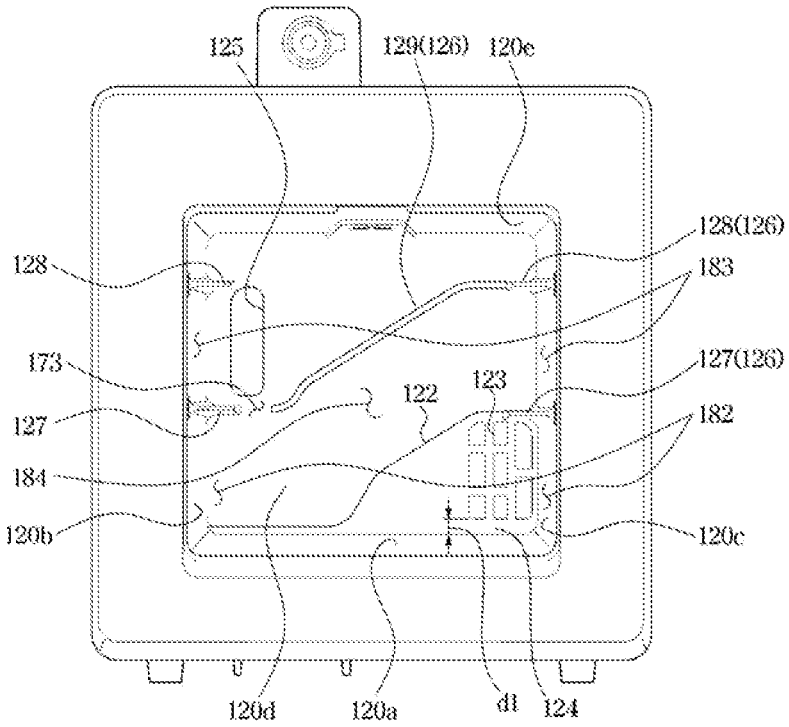
Figure 19:
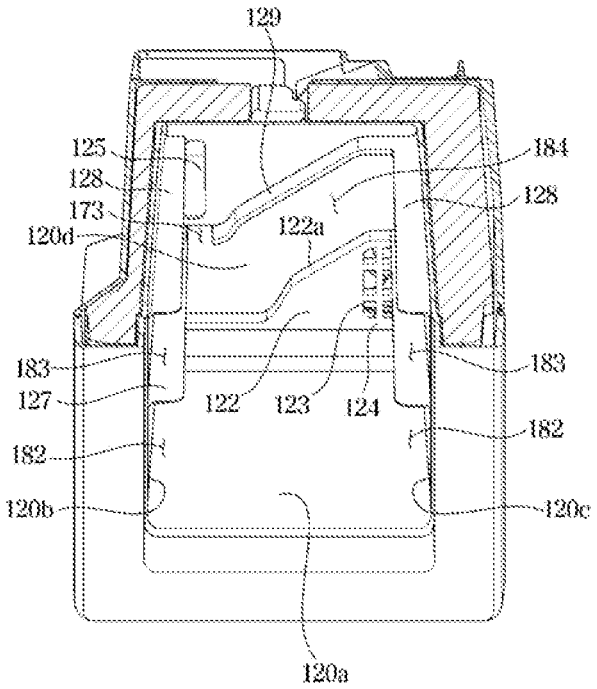

FIG. 13 is a view illustrating cool air circulating in a flow channel of the apparatus for producing dairy products shown in FIG. 2. FIG. 14 is a cross-sectional view of the apparatus for producing dairy products shown in FIG. 13. FIG. 15 is a cross-sectional view taken along line A-A' of FIG. 13 in a state where the container assembly is omitted. FIG. 16 is a cross-sectional view taken along line B-B' of FIG. 13 in a state where the container assembly is omitted. FIGS. 17 to 19 are cross-sectional views of a flow channel formed in the inner case of the apparatus for producing dairy products shown in FIG. 2 in various angles.

Referring to FIGS. 13 to 19, an accommodation space is formed by being surrounded by inner surfaces of the inner case 120, i.e., a left surface 120*b*, a right surface 120*c*, a bottom surface 120*a*, a top surface 120*e*, and a rear surface 120*d* of the inner case 120. A second suction port 123 may be provided at the rear surface 120*d* of the inner case 120 to communicate with the inflow channel 181 formed in the outer case 110. The second suction port 123 may communicate with the first suction port 113. The second suction port 123 may be provided at a position corresponding to the first suction port 113. A first discharge port 125 may be provided at the rear surface 120*d* of the inner case 120 to discharge cool air inside the apparatus for producing dairy products 100 out of the apparatus for producing dairy products 100.

Specifically, one end of the blower fan mount 170 may communicate with the first suction port 113, and the other end of the blower fan mount 170 may communicate with the second suction port 123. That is, the first suction port 113 may be connected to the second suction port 123 via the blower fan mount 170. The first suction port 113 may communicate with the second suction port 123 via the inflow channel 181.

More specifically, the rear surface of the insulator 130 may have an opening at a position corresponding to the first suction port 113 provided at the rear surface of the outer case 110. The first suction port 113 may communicate with the second suction port 123 via the opening. The blower fan mount 170 provided with the first suction port 113 may be connected to the second suction port 123 via the opening, and the first suction port 113 may communicate with the second suction port 123 via the inflow channel 181 formed inside the blower fan mount 170. However, the embodiment is not limited thereto, and a part of the inflow channel 181 may be formed inside the insulator 130.

The second suction port 123 may be provided to be spaced apart from the bottom surface 120*a* of the inner case 120 by a predetermined distance dl. That is, the lowermost end of the second suction port 123 may be located at a higher position than the bottom surface 120*a* such that the lowermost end of the second suction port 123 is not in contact with the bottom surface 120*a*.

As described above, a part of the rear surface 120*d* of the inner case 120 located between the lowermost end of the second suction port 123 and the bottom surface 120*a* in the vertical direction is referred to as leakage prevention bump 124. The leakage prevention bump 124 may prevent milk and/or a dairy product flowing over the container 141 onto the bottom surface 120*a* from passing through the second suction port 123 and flowing into the inflow channel 181.

The cooling flow channel 180 may be formed by ribs 126 provided at the left and right surfaces 120*b* and 120*c* and the rear surface 120*d* of the inner case 120 and door ribs 147 provided at the rear surface of the assembly door 145. The cooling flow channel 180 may be provided between the suction ports 113 and 123 and the discharge ports 115 and 125. Specifically, the cooling flow channel 180 may be provided between the second suction port 123 and the first discharge port 125. The cooling flow channel 180 may receive cool air from the inflow channel 181.

The door ribs 147 at the rear surface of the assembly door 145 may be connected to the ribs 126 of the left and right surfaces 120*b* and 120*c* of the inner case 120. The door ribs 147 of the rear surface of the assembly door 145 and the ribs 126 of the left and right surfaces 120*b* and 120*c* of the inner case 120 partition the cooling flow channel 180 into upper and lower channels to form a first flow channel 182 and a second flow channel 183.

The apparatus for producing dairy products 100 may include a discharge flow channel 185 penetrating the insulator 130 and connecting the first discharge port 125 with the second discharge port 115. That is, the discharge flow channel 185 may communicate with the cooling flow channel 180. Air absorbing heat from the container 141 while passing through the cooling flow channel 180 flows into the discharge flow channel 185 from the cooling flow channel 180. After passing through the discharge flow channel 185, the air is discharged to the refrigerator compartment 21 through the second discharge port 115. The inflow channel 181, the cooling flow channel 180, and the discharge flow channel 185 may constitute a circulation flow channel 180, 181, and 185 that circulates through the refrigerator compartment 21 and the apparatus for producing dairy products 100. The case 101 may include the inflow channel 181, the cooling flow channel 180, and the discharge flow channel 185.

The ribs 126 may include a first rib 127, a second rib 128, and a third rib 129. The ribs 126 may protrude from the inner surface of the inner case 120.

The first ribs 127 may be located approximately at the middle of the heights of the left and right surfaces 120*b* and 120*c* of the inner case 120. A part of the first flow channel 182 may be provided in a space between the bottom surface 120*a* of the inner case 120 and the first rib 127.

Specifically, when the container assembly 140 mounted with the container 141 is inserted into the inner case 120, the first ribs 127 may be arranged adjacent to the container 141. In this case, a space surrounded by the side surfaces of the container 141, the first ribs 127, the bottom surface 120*a* of the inner case 120, and the left and right surfaces 120*b* and 120*c* of the inner case 120 may correspond to a part of the first flow channel 182.

The first flow channel 182 may be provided to constitute a part of the cooling flow channel 180 and surround lower portions of the left and right surfaces and a lower portion of the front surface of the container 141. A part of the first flow channel 182 surrounding a lower portion of the front surface of the container 141 may be formed by a door rib 147 provided at the assembly door 145. Specifically, a pair of door ribs 147 vertically arranged may be provided at the assembly door 145, and a space surrounded by a relatively low door rib 147, the rear surface of the assembly door 145, the front surface of the container 141, and the left and right surfaces 120*b* and 120*c* of the inner case 120 may correspond to a part of the first flow channel 182. Therefore, when the assembly door 145 is inserted into the inner case 120, the first ribs 127 may be connected to the door rib 147 thereby forming the first flow channel 182.

One end of the first flow channel 182 may communicate with the second suction port 123. In other words, the second suction port 123 may be provided between the first rib 127 and the bottom surface 120*a* of the inner case 120. However, the embodiment is not limited thereto, a part of the second suction port 123 may be provided at a higher position than that of the first rib 127.

The second ribs 128 may be located at upper positions of the left and right surfaces 120*b* and 120*c* of the inner case 120. That is, the second ribs 128 may be formed at higher positions than the first ribs 127. A part of the second flow channel 183 may be provided in a space between the first ribs 127 and the second ribs 128.

Specifically, when the container assembly 140 mounted with the container 141 is inserted into the container assembly 140, the second ribs 128 may be arranged close to the container 141. In this case, a space surrounded by the side surfaces of the container 141, the second ribs 128, the first ribs 127, and the left and right surfaces 120*b* and 120*c* of the inner case 120 may correspond to a part of the second flow channel 183.

The second flow channel 183 may be provided to constitute a part of the cooling flow channel 180 and surround upper portions of the left and right surfaces of the container 141, and an upper portion of the front surface of the container 141. A part of the second flow channel 183 surrounding the upper portion of the front surface of the container 141 may be formed by the door ribs 147 provided at the assembly door 145. Specifically, a pair of door ribs 147 vertically arranged may be provided at the assembly door 145, and a space surrounded by the pair of door ribs 147, the rear surface of the assembly door 145, the front surface of the container 141, and the left and right surfaces 120*b* and 120*c* of the inner case 120 may correspond to a part of the second flow channel 182. Therefore, when the assembly door 145 is inserted into the inner case 120, the second ribs 128 may be connected to the door rib 147 thereby forming the second flow channel 183.

One end of the second flow channel 183 may communicate with the first discharge port 125. In other words, the first discharge port 125 may be provided between the first rib 127 and the second rib 128. However, the embodiment is not limited thereto, a part of the first discharge port 125 may be formed at a position higher than that of the second rib 128 or at a position lower than that of the first rib 127.

The third rib 129 may be provided at the rear surface 120*d* of the inner case 120. The third rib 129 may protrude forward from the rear surface 120*d* of the inner case 120. The rear surface 120*d* of the inner case 120 may be provided with a step-like protrusion 122 which constitutes a part of the rear surface 120*d* of the inner case 120, protrudes forward from the bottom surface 120*a* of the inner case 120 to form a slope 122*a*, and is connected to the bottom surface 120*a* of the inner case 120. The third flow channel 184 may be formed in a space between the third rib 129 and the step-like protrusion 122.

Specifically, when the container assembly 140 mounted with the container 141 is inserted into the inner case 120, the third rib 129 and the step-like protrusion 122 may be arranged adjacent to the container 141. In this case, similarly to the first flow channel 182 and the second flow channel 183, a space surrounded by the rear surface of the container 141, the third rib 129, the step-like protrusion 122, and the rear surface 120*d* of the inner case 120 may correspond to the third flow channel 184.

However, the embodiment is not limited thereto, and a pair of third ribs 129 may be provided at the rear surface 120*d* of the inner case 120 instead of the step-like protrusion 122, and the third flow channel 184 may be formed in a space between the pair of third ribs 129.

The second suction port 123 may be formed below the slope 122*a* of the step-like protrusion 122. One end of the slope 122*a* may be connected to one end of the first rib 127. As shown in the drawings, the slope 122*a* of the step-like protrusion 122 may be formed to incline upward from the left side of the bottom surface of the inner case 120 to the second suction port 123 of the right side of the inner case 120 and may be connected to one end of the first rib 127 formed at the right surface 120*c* of the inner case 120.

However, the embodiment is not limited thereto. For example, in the case where the second suction port 123 is formed below the first rib 127 formed at the left surface 120*b* of the inner case 120, the slope 122*a* of the step-like protrusion 122 may be formed to incline upward from the right side of the bottom surface 120*a* of the inner case 120 to the second suction port 123 of the left side of the inner case 120 and may be connected to one end of the first rib 127 formed at the left surface 120*b* of the inner case 120.

The third rib 129 may have a slop corresponding to the slope 122*a* of the step-like protrusion 122, and the third rib 129 may be connected to one end of the second rib 128 provided at the same side surface as the first rib 127 connected to the slope 122*a* of the step-like protrusion 122. In the case of the apparatus for producing dairy products 100 shown in the drawings, the third rib 129 is connected to the second rib 128 of the right surface 120*c* of the inner case 120, but is not limited thereto.

The third flow channel 184 may connect the first flow channel 182 with the second flow channel 183. The third flow channel 184 may have a slope corresponding to the third rib 129 and the slope 122*a* of the step-like protrusion 122. The lower end of the third flow channel 184 may communicate with one end of the first flow channel 182, and the upper end of the third flow channel 184 may communicate with the second flow channel 183.

Therefore, cool air of the refrigerator compartment 21 flowing into the apparatus for producing dairy products 100 through the inflow channel 181 cools the lower portion of the container 141 while flowing through the first flow channel 182, and then moves to the second flow channel 183 through the third flow channel 184. The cool air arriving at the second flow channel 183 cools the upper portion of the container 141 while flowing through the second flow channel 183 and then is discharged back to the refrigerator compartment 21 through the discharge flow channel 185.

The apparatus for producing dairy products 100 may include a guide slit 173.

The upper end of the third rib 129 having a slope may be connected to the second rib 128 and the lower end may be arranged adjacent to the first rib 127. The lower end of the third rib 129 may be provided adjacent to the first discharge port 125 disposed between the first rib 127 and the second rib 128. The guide slit 173 may be provided between the first rib 127 and the third rib 129. The guide slit 173 may be provided below the first discharge port 125.

Specifically, in the case of the apparatus for producing dairy products 100 shown in the drawings, the first discharge port 125 may be formed on the upper left side of the rear surface 120*d* of the inner case 120, and the lower end of the third rib 129 may be located at the same height as that of the first rib 127 of the left surface 120*b*. Because the first discharge port 125 is formed between the first rib 127 and the second rib 128, the first rib 127 of the left surface 120*b* and the lower end of the third rib 129 may be located below the first discharge port 125, and the guide slit 173 may be provided between the lower end of the third rib 129 and the first rib 127 of the left surface 120*b*. that is, the guide slit 173 in the form of a gap shape may be formed below the first discharge port 125.

Therefore, milk and/or a dairy product flowing over the container 141 onto the rib 126 may be guided to the bottom surface 120*a* of the inner case 120 by the guide slit 173. Therefore, it is possible to prevent milk and/or the dairy product flowing over the container 141 from flowing into the discharge flow channel 185 through the first discharge port 125. Milk and/or the dairy product drained through the guide slit 173 drops onto the bottom surface 120*a* of the inner case 120, and thus the user may easily remove the milk and/or the dairy product. In other words, the plurality of slits, the guide slit 173 and the drain slit 172, provided in the circulation flow channel 180, 181, and 185 may prevent the milk and/or the dairy product overflowing from the container 141 from remaining in the circulation flow channel 180, 181, and 185.

Figure 20:
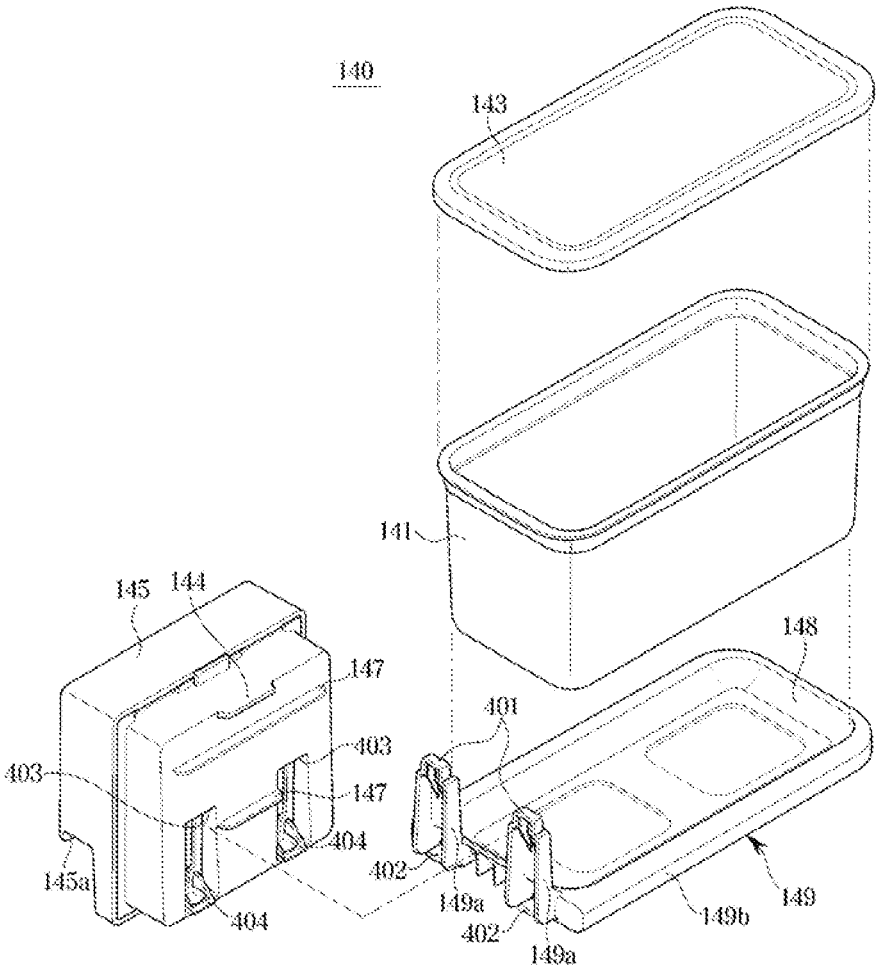
FIG. 20 is an exploded perspective view of the container assembly shown in FIG. 3.
Figure 21:
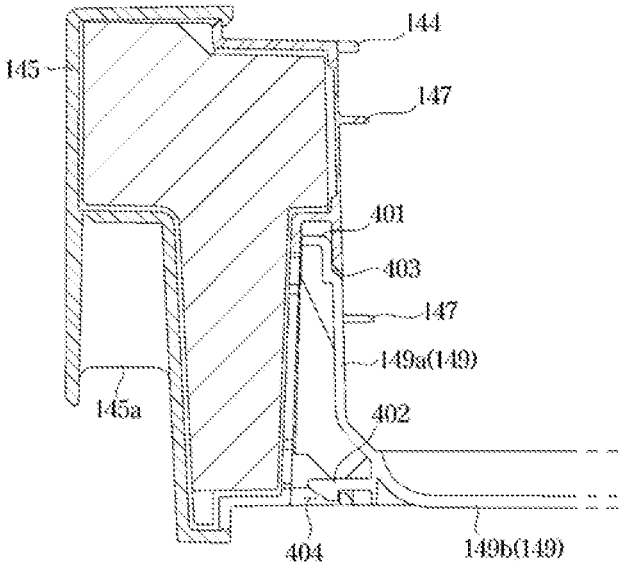
FIG. 21 is a side cross-sectional view of the container shown in FIG. 3.

FIG. 20 is an exploded perspective view of the container assembly shown in FIG. 3. FIG. 21 is a side cross-sectional view of the container shown in FIG. 3.

Referring to FIGS. 20 and 21, the container 141 has an open top, and is inserted into the apparatus for producing dairy products 100 in a state of storing milk as a raw ingredient to produce a dairy product. To prevent milk and/or a produced dairy product from flowing over the dairy container 141, the lid 143 is provided on the open top of the container 141 to seal the container 141. The container 141 may be detachably coupled to the mounting bracket 149 in a state of being covered with the lid 143.

Milk stored in the container 141 may be heated by the heater 150 to be fermented at an appropriate temperature to produce a dairy product. Overfermentation of the produced dairy product may be prevented by cooling of the blower fan 160 and the dairy product may be kept refrigerated in a fresh state.

Because the assembly door 145 slides to open or close the opening 121 of the inner case 120 and the container 141 is detachably mounted on the mounting bracket 149 coupled to the assembly door 145, the container 141 is inserted thereinto or withdrawn therefrom in accordance with opening and closing of the assembly door 145.

A separation-preventing protrusion 144 to prevent separation of the container 141 may be provided at an upper portion of the rear surface of the assembly door 145. Specifically, the mounting bracket 149 may be coupled to the rear surface of the assembly door 145 and the separation-preventing protrusion 144 may be formed at the upper end of the rear surface of the assembly door 145 in a form protruding from the rear surface of the assembly door 145 to face the mounting bracket 149. That is, the separation-preventing protrusion 144 may be arranged parallel to the mounting bracket 149 with a space therebetween.

The mounting bracket 149 may include a holder 148 formed to surround the bottom surface of the container 141 and lower edges of the container 141. Specifically, the lower edges of the container 141 may be rounded to have a curved surface and the holder 148 of the mounting bracket 149 may have a curved surface corresponding to the curved surface of the lower edges of the container 141. When the container 141 is mounted on the mounting bracket 149, the holder 148 may surround the edges of the container 141 and prevent the container 141 from being separated from the mounting bracket 149.

The container 141 may be detachably coupled to the mounting bracket 149 in a state being covered with the lid 143. Specifically, the container 141 may be mounted in a space between the mounting bracket 149 and the separation-preventing protrusion 144, the lower edges of the container 141 may be supported by the holder 148, and the upper end of the container 141 may be supported by the separation-preventing protrusion 144. Therefore, when the container 141 is inserted into or withdrawn from the inner case 120 in a state being mounted in the container assembly 140, separation of the container 141 from the mounting bracket 149 may be prevented even when an impact is applied thereto.

The mounting bracket 149 may be coupled to the rear surface of the assembly door 145. The mounting bracket 149 may have an L-shape. Specifically, the mounting bracket 149 may include a first portion 149*a* vertically extending and coupled to the assembly door 145 and a second portion 149*b* horizontally extending, formed at the lower end of the first portion 149*a*, and mounted with the container 141.

The upper end of the first portion 149*a* may include a protruding portion 401 inserted into the assembly door 145, and the lower end of the first portion 149*a* may include a coupling hook 402 coupled to the assembly door 145.

The assembly door 145 may include a fastening groove 403 formed at a position corresponding to the protruding portion 401 and a coupling groove 404 formed at a position corresponding to the coupling hook 402.

The fastening groove 403 may have an opening facing downward of the assembly door 145. Therefore, as the mounting bracket 149 is lifted upward from the lower side of the assembly door 145, the protruding portion 401 may pass through the opening of the fastening groove 403 to be inserted into the fastening groove 403.

The coupling groove 404 may be formed at the lower end of the rear surface of the assembly door 145. As the mounting bracket 149 is pushed forward from the rear side of the assembly door 145, the coupling hook 402 may be coupled to the coupling groove 404.

The mounting bracket 149 may be coupled to the assembly door 145 by inserting the protruding portion 401 into the fastening groove 403, and then coupling the coupling hook 402 of the mounting bracket 149 to the coupling groove 404 by rotating the mounting bracket 149 about the inserted protrusion 401 as a shaft. The protruding portion 401 and the coupling hook 402 may be provided in plural and the fastening groove 403 and the coupling groove 404 corresponding thereto may also be provided in plural.

The apparatus for producing dairy products and the refrigerator including the same are described above with reference to the accompanying drawings based on specific shapes and directions. However, it will be understood by one of ordinary skill in the art that the embodiments of the disclosure are provided for illustration and may be implemented in different ways without departing from the spirit and scope of the disclosure.

What is claimed is:

1. A refrigerator comprising:

an outer cabinet;

an inner cabinet provided inside the outer cabinet and including a refrigerator compartment formed in the inner cabinet; and a dairy product maker provided inside the refrigerator compartment to produce a dairy product, wherein the dairy product maker comprises:

a case comprising a suction port and a discharge port to allow cool air to flow in and out, respectively;

a container to store the produced dairy product, and to be inserted into or withdrawn from the case;

a heater to apply heat to the container to produce the dairy product in the container;

a plurality of ribs protruding from an inner surface of the case to form a cooling flow channel with the inner surface when the container is accommodated in the case, and provided between the suction port and the discharge port to cool the container; and a guide slit to guide the produced dairy product, overflowing into the cooling flow channel from the container, to a bottom surface of the case.

2. The refrigerator according to claim 1, wherein the dairy product maker further comprises a blower fan configured to suck cool air from the refrigerator compartment into the case through the suction port.

3. The refrigerator according to claim 2, wherein the case comprises a blower fan mount to form an inflow channel to communicate with the cooling flow channel to supply the cool air, and the blower fan is mounted on the blower fan mount.

4. The refrigerator according to claim 3, wherein the blower fan mount comprises a fan lower mount wall constituting the lower surface of the blower fan mount and supporting the blower fan, and a drain slit to drain the produced dairy product, overflowing to the blower fan mount from the container, through the inflow channel, and is formed in the fan lower mount wall.

5. The refrigerator according to claim 3, wherein the dairy product maker further comprises a bracket coupled to a rear surface of the case to couple the dairy product maker to the inner cabinet and support the blower fan.

6. The refrigerator according to claim 5, wherein the bracket comprises a misassembly preventing protrusion coupled to the blower fan to prevent the blower fan from being misassembled to the blower fan mount by guiding the blower fan to be properly aligned and mounted to the blower fan mount.

7. The refrigerator according to claim 6, further comprising a driving motor configured to rotate the blower fan, a fan case to accommodate the driving motor and the fan, and a grommet provided at the fan case to support the blower fan.

8. The refrigerator according to claim 7, wherein the fan case comprises an outer wall formed along a circumferential direction of the fan to cover the fan and a protrusion protruding from an outer surface of the outer wall to be coupled to the grommet, one side of the fan case is provided with a blocking wall formed between the outer wall and the protrusion to prevent the misassembly preventing protrusion from being inserted and coupled to the blower fan, and an other side of the fan case is provided with an insertion groove to which the misassembly preventing protrusion is inserted and coupled.

9. The refrigerator according to claim 1, wherein the suction port is spaced apart from the bottom surface of the case, and the case further comprises a leakage prevention bump formed between the suction port and the bottom surface of the case to prevent the produced dairy product overflowing from the container to the bottom surface of the case from the case, from passing through the suction port.

10. The refrigerator according to claim 1, wherein the discharge port is formed above the rear surface of the case, and the guide slit is formed below the discharge port to prevent the produced dairy product, overflowing from the container, from passing through the discharge port.

11. The refrigerator according to claim 1, wherein the dairy product maker further comprises a container assembly comprising the container, an assembly door to open or close the case, and a mounting bracket on which the container is detachably mounted.

12. The refrigerator according to claim 11, wherein the assembly door comprises a separation-preventing protrusion protruding from an upper end of the assembly door to prevent the container from being separated from the mounting bracket, the mounting bracket comprises a holder spaced apart from the separation-preventing protrusion and holding the container, and the container is located between the separation-preventing protrusion and the holder.

13. The refrigerator according to claim 11, wherein the mounting bracket comprises a first portion coupled to the assembly door and a second portion connected to the first portion and to allow the container to be detachably mounted to the mounting bracket, and the first portion comprises a protruding portion formed at an upper end of the first portion and inserted into one end of the assembly door and a coupling hook formed at a lower end of the first portion and coupled to the assembly door.

14. The refrigerator according to claim 1, wherein a guide protrusion is formed at a side surface of the inner cabinet, and a guide groove to which the guide protrusion is coupled is formed in an outer side surface of the dairy product maker.

15. The refrigerator according to claim 14, wherein the dairy product maker further comprises a bracket comprising a coupling protrusion to be coupled to a coupling hole of the inner cabinet, and the guide protrusion slides into the guide groove to be coupled to the guide groove and the coupling protrusion is inserted into the coupling hole by inserting the dairy product maker into the refrigerator compartment.

16. A refrigerator comprising:

an outer cabinet;

an inner cabinet provided inside the outer cabinet to form a refrigerator compartment;

and an apparatus for producing dairy products provided inside the refrigerator compartment, wherein the apparatus for producing dairy products includes:

a case;

a container assembly to be accommodated in the case;

a container to store a dairy product produced, and to be accommodated in the container assembly;

a heater to apply heat to the container to produce the dairy product in the container;

a circulation flow channel formed when the container is accommodated in the container assembly, and in which cool air cooling the container circulates; and a plurality of slits provided to prevent the produced dairy product, overflowing from the container, from remaining in the circulation flow channel.

17. The refrigerator according to claim 16, wherein the case includes a suction port through which cool air of the refrigerator compartment flows in and a discharge port through which cool air inside the case is discharged, and the plurality of slits includes a guide slit arrange adjacent to the discharge port to guide the produced dairy product, overflowing into the circulation flow channel from the container, to a bottom surface of the case.

18. The refrigerator according to claim 16, wherein the container assembly further includes:

an assembly door provided to open or close the case; and a mounting bracket including a holder to hold the container, wherein the assembly door comprises a separation-preventing protrusion protruding from an upper end of the assembly door, and to support an upper end of the container mounted on the holder.

19. The refrigerator according to claim 18, wherein the mounting bracket includes a first portion coupled to the assembly door and a second portion provided with the holder, the first portion includes a protruding portion formed at an upper end of the first portion and inserted into one end of the assembly door and a coupling hook formed at a lower end of the first portion and coupled to the assembly door.

20. The refrigerator according to claim 16, wherein the inner cabinet includes a guide protrusion protruding from one surface of the inner cabinet and a coupling hole formed in another surface of the inner cabinet, and the apparatus for producing dairy products further includes a guide groove formed in a side surface of the apparatus for producing dairy product and a bracket including a coupling protrusion coupled to the coupling hole.

* * * * *